US009249584B2

(12) United States Patent
Pagones et al.

(10) Patent No.: US 9,249,584 B2
(45) Date of Patent: Feb. 2, 2016

(54) ACOUSTIC DAMPENER

(71) Applicant: James Hardie Technology Limited, Dublin 2 (IE)

(72) Inventors: Peter Pagones, Sydney (AU); James Gleeson, Sydney (AU)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 14/367,201

(22) PCT Filed: Dec. 22, 2012

(86) PCT No.: PCT/EP2012/076861
§ 371 (c)(1),
(2) Date: Jun. 19, 2014

(87) PCT Pub. No.: WO2013/093109
PCT Pub. Date: Jun. 27, 2013

(65) Prior Publication Data

US 2015/0013244 A1 Jan. 15, 2015

(30) Foreign Application Priority Data

Dec. 22, 2011 (GB) ..... 1122133.0

(51) Int. Cl.
*E04B 1/82* (2006.01)
*E04F 15/20* (2006.01)

(52) U.S. Cl.
CPC ..... *E04F 15/20* (2013.01); *Y10T 29/4957* (2015.01)

(58) Field of Classification Search
CPC ..... E04F 15/20; Y10T 29/4957
USPC ..... 52/144, 145, 347, 404.1; 181/30
See application file for complete search history.

(56) References Cited

U.S. PATENT DOCUMENTS 3,271,916 A * 9/1966 Omholt ..... 52/393
3,354,595 A * 11/1967 Abciuk ..... 52/506.1

(Continued)

FOREIGN PATENT DOCUMENTS

GB 2 428 703 7/2007
GB 2 477 210 7/2011

(Continued)

OTHER PUBLICATIONS

International Search Report and Written Opinion for corresponding PCT Application No. PCT/EP2012/076861, filed Dec. 22, 2012, dated Apr. 10, 2013, 9 pages.

*Primary Examiner* — Charles A Fox
*Assistant Examiner* — James Buckle, Jr.
(74) *Attorney, Agent, or Firm* — Knobbe, Martens, Olson & Bear, LLP

(57) ABSTRACT

An acoustic dampener (100) comprising a base member (101) having a first surface (102) and a second surface (103), the first surface (102) and the second surface (103) are spaced apart from each other defining a thickness (104) therebetween. The acoustic dampener (100) further comprising a pair of side arms (105), each having a first end (109) and a second end (110). Each side arm (105) is attached to the base member (101) at its first end (109) at a predetermined angle. The side arm (105) extends from the base member (101) to form a channel formation (119) to receive a batten. A flange (106) extends substantially orthogonally from the second end (110) of each side arm (105) for retaining a batten within the channel formation (119).

17 Claims, 5 Drawing Sheets

(56) References Cited

U.S. PATENT DOCUMENTS

| | | | | |
|---|---|---|---|---|
| 3,511,001 | A * | 5/1970 | William, Jr. | 52/126.5 |
| 4,856,250 | A * | 8/1989 | Gronau et al. | 52/480 |
| 5,369,927 | A * | 12/1994 | Counihan | 52/403.1 |
| 5,465,548 | A * | 11/1995 | Niese | 52/741.1 |
| 6,044,606 | A * | 4/2000 | Hamar | 52/403.1 |
| 7,316,056 | B2 * | 1/2008 | Haytayan | 29/432 |
| 7,624,554 | B2 * | 12/2009 | Chae | 52/480 |
| 2004/0237464 | A1 * | 12/2004 | Khan | 52/782.1 |

FOREIGN PATENT DOCUMENTS

| | | |
|---|---|---|
| WO | WO 03/025308 | 3/2003 |
| WO | WO 2013/093109 | 6/2013 |

* cited by examiner

ACOUSTIC DAMPENER

FIELD OF THE INVENTION

The present invention relates to dampening of acoustic energy and in particular to acoustic dampeners suitable for use in dampening of acoustic energy transmissions in buildings.

The invention has been developed primarily for use as acoustic dampeners suitable for use in acoustic dampening of flooring systems in buildings and will be described hereinafter with reference to this application. However, it will be appreciated that the invention is not limited to this particular field of use.

BACKGROUND OF THE INVENTION

Any discussion of the prior art throughout the specification should in no way be considered as an admission that such prior art is widely known or forms part of the common general knowledge in the field.

Strip form acoustic insulation for use between sheet building products and a structural building substructure, such as timber joists on a frame, are known. They are generally arranged between a flooring sheet and a flooring substructure and the flooring sheet is directly fixed to the flooring substructure through the insulating strip. Although some reduction in sound transmission may occur, it is limited because of the direct connection of the flooring sheets to the flooring substructure.

Insulating systems, for providing dampening of acoustic transmission, including multiple layers of sheet material with graded properties, are known. These multiple layer systems, such as those employing two or more layers of paper faced gypsum boards, increase the cost of a flooring system both by increasing the amount of materials used for a given floor area and by requiring additional labour time for installation.

OBJECT OF THE INVENTION

It is an object of the present invention to overcome or ameliorate at least one of the disadvantages of the prior art, or to provide a useful alternative.

It is an object of the invention to provide an acoustic dampener suitable for use in buildings, for decoupling contact between all hard surface components and thereby reducing acoustic energy transmission, while maintaining low component cost and low installation skill level.

SUMMARY OF THE INVENTION

According to the invention there is provided an acoustic dampener comprising:

a base member, wherein the base member comprises a first surface and a second surface, the first and second surface being spaced apart from each other defining a thickness therebetween;

at least two side arms, wherein each side arm comprises a first end and a second end, each side arm extending from the first surface of the base member at a pre-determined angle, such that there is a channel formed whereby each side arm and the base member form the sides and the base of the channel formation respectively; and a pair of flanges, each flange extending substantially orthogonally from the second end of each side arm and wherein the predetermined angle is elastically deformable.

The advantage of the present invention is that it provides an acoustic dampener for use in building construction, which removes or decouples contact between flooring sheet components and substructure components thereby reducing acoustic energy transmission, while maintaining low component cost and low installation skill level.

In the following the description the first and second ends of each side arm are also referred to as the distal edge and proximal edge of each side arm, wherein each side arm extends from the proximal edge at the predetermined angle from the side edge of the base to form the channel formation. Each flange within the pair or flanges extend substantially orthogonally from respective distal edges of the side arms.

It is acknowledged that the term 'comprise' may, under varying jurisdictions be provided with either an exclusive or inclusive meaning. For the purpose of this specification, the term comprise shall have an inclusive meaning that it should be taken to mean an inclusion of not only the listed components it directly references, but also other non-specified components. Accordingly, the term 'comprise' is to be attributed with as broad an interpretation as possible within any given jurisdiction and this rationale should also be used when the terms 'comprised' and/or 'comprising' are used.

In one embodiment of the invention the channel formation is configured to receive a batten.

In a further embodiment of the invention the or each flange is configured to retain a batten within the channel.

According to the invention there is also provided a floor structure comprising an acoustic dampener of the invention securable to a structural substrate, a batten disposed within the channel formation and flooring material secured to the batten.

In one embodiment of the invention the first end of each of the at least one of the pair of side arms are pivotably connected to the base member. In a further embodiment of the invention, at least one of the two side arms is pivotably connected to the base at the junction between the first surface of the base and the first end of the side arm.

In one embodiment of the invention at least one of the pair of flanges is pivotably connected to the pair of side arms. In a further embodiment of the invention, at least one of the pair of flanges is pivotably connected to the side arm at the junction between the flange and the second end of the aside arm.

In a further embodiment of the invention, the junction between the side arms and the base, is elastically deformable thus allowing the predetermined angle, $\alpha$ to alter radically during insertion and removal of the batten into the channel formation and also providing tolerance to the position of the side arm prior to and during use of the acoustic dampener. In one embodiment of the invention the pre-determined angle $\alpha$, falls within a range of 80 to 90 degrees.

In a further embodiment of the invention, wherein the base member further comprises at least one aperture contained within the thickness of the base member. In a further embodiment of the invention the at least one aperture extends through the second face of the base member to form at least one recessed channel on the second face of the base member. In a further embodiment of the invention the first face of the base member further comprises at least one profiled portion.

The advantage of this is that the at least one aperture forms an internal void or space within the base of the invention, therefore it reduces the volume of material required to form the base.

In a further embodiment of the invention, the base of the acoustic dampener comprises dimensions of between approximately 50 to 100 mm wide, preferably between approximately 60 to 80 mm wide, and most preferably between approximately 75 to 80 mm wide. In a further embodiment of the invention the height of acoustic dampener is between approximately 20 to 80 mm, preferably between approximately 25 to 50 mm, and most preferably between approximately 30 to 35 mm. In a further embodiment of the invention the thickness of the base is between approximately 10 to 15 mm, preferably is approximately 12 mm thick. In one embodiment, base 101 are approximately 10 to 15 mm thick, more. In another embodiment, base 101 is approximately 12 mm thick.

In a further embodiment of the invention, each side arm is approximately 10 to 70 mm in height, preferably approximately 15 to 40 mm in height, most preferably approximately 20 to 25 mm.

In one embodiment of the invention, the predetermined angle α, is angled at approximately 85 degrees between the side arm and the base, and each side arm is approximately 5 mm thick at its first or proximal end and approximately 3 mm thick at its second or distal end.

In a further embodiment of the invention, each of the pair of flanges is approximately 10 to 15 mm wide, and each may be approximately 1.5 mm thick.

In a further embodiment of the invention the or each aperture may be approximately 5 mm in diameter where enclosed channels are used, or 5 mm in maximum width in embodiments where a complex shape aperture is used. Conveniently the apertures are arranged in a preselected pattern within the thickness of the base.

In a further embodiment of the invention, the base further comprises a recessed channel. In a further embodiment of the invention, the at least one aperture formed in the base of the invention extends through the second face of the base to form at least one recessed channel.

In a further embodiment of the invention, the first surface of the base further comprises at least one profiled portion for reducing contact area with a batten.

In a further embodiment of the invention, the base of the acoustic dampener is formed from at least one resilient polymer, selected form the group comprising a closed cell foam, a closed cell linear foam, a closed cell non-linear foam, or a polyolefin foam. It is to be understood that any suitable polymer known to a person skilled in the art which will achieve the functionality of the invention can also be used.

In a further embodiment of the invention, the components of the acoustic dampener are integrally formed together to form a single unit. In this embodiment of the invention the base, the side arms and the flange are integrally formed together as a single unit.

In a further embodiment of the invention, the acoustic dampener is formed by an extrusion process or a co-extrusion process.

In a further embodiment of the invention, the base comprises at least two portions formed of materials having different acoustic dampening properties.

In a further embodiment of the invention, the batten is a fibre cement batten.

In a further embodiment of the invention, the flooring material is a fibre cement flooring material.

According to the invention, there is also provided a method of installing a floor structure, including the steps of:

(a) selecting and/or preparing one or more lengths of acoustic dampener in accordance with the invention;
(b) fixing each length of acoustic dampener in a predetermined position on a structural flooring substrate to form an acoustic dampener array,
(c) elastically deforming at least one side arm on each length of acoustic dampener array and inserting batten sections into each length of acoustic dampener to substantially fill the "U" shaped channel to form a batten array.
(d) allowing the side arm on each length of acoustic dampener to return to its substantially original position, and
(e) fixing at least one flooring sheet to each batten section, wherein only the acoustic dampener array is directly fixed to the flooring structural substrate and each flooring section is directly fixed only to at least one batten section in the batten array From the foregoing, it will be appreciated that certain embodiments of the preferred embodiments provide a method of installing an acoustic dampened building section. In particular, certain embodiments of the method are designed to form a building section having less acoustic transmission than a similar building section constructed without the acoustic dampener. These and other objects and advantages of the preferred embodiments of the present invention will become apparent from the following description taken in conjunction with the following drawings.

BRIEF DESCRIPTION OF THE DRAWINGS

The invention will now be described more particularly with reference to the accompanying drawings, which show by way of example only various embodiments of the façade system of the invention.

In the drawings.

PREFERRED EMBODIMENT OF THE INVENTION

Figure 1A:
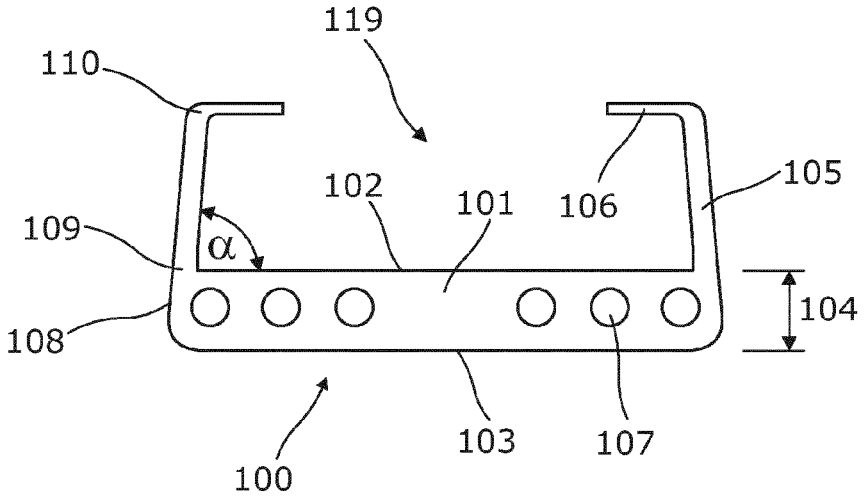
FIGS. 1 (*a*) and 1 (*b*) are a cross-sectional view and a perspective view of an acoustic dampener according to a first embodiment of the invention.

Reference will now be made to the drawings, wherein like numerals refer to like elements throughout. The drawing figures are not necessarily to scale and certain features may be shown exaggerated in scale or in somewhat generalized or schematic form in the interest of clarity and conciseness.

Figure 1B:
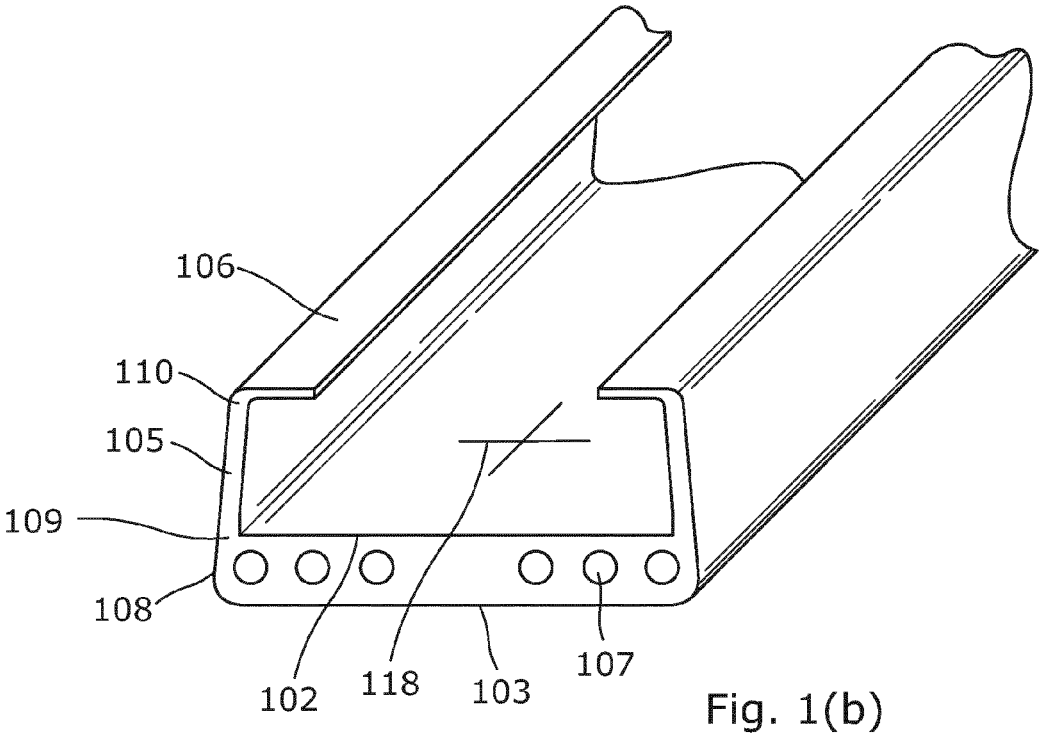

Referring now to FIGS. 1(*a*) and 1(*b*), there is shown an acoustic dampener 100 according to one embodiment of the invention. Acoustic dampener 100 comprises a base 101 including a first surface 102 and a second surface 103 which are spaced apart from each other defining thickness 104 therebetween. There is at least one aperture 107 formed in the thickness. The acoustic dampener 100 further comprises a pair of side edges 108 and side arms 105, each having a first end or distal edge 110 and a second end or proximal edge 109.

Side arms 105 are each conjoined to the base 101 at the first or proximal edge to form a substantially "U" shaped channel 130 adapted to receive a batten 124. The angle α, between each side arm 105 and the base 101 is predetermined to accommodate a batten within the substantially 'U' shaped channel 130. The acoustic dampener 100 also comprises a pair of flanges 106, each of which extends substantially orthogonally from a respective second end or distal edge 110 of each side arm 105 within the pair of side arms 105. The junction between the side arms 105 and the base 101, is elastically deformable thus allowing the predetermined angle, α to alter radically during insertion and removal of a batten and also providing tolerance to the position of the side arm prior to and during use of the acoustic dampener 100.

In this embodiment of the invention, base 101, pair of side arms 105 and pair of flanges 106 are integrally formed by extrusion of a resilient closed cell foamed polyolefin polymer. Other polymers and manufacturing processes may be used. Examples of polymers that could be used include Natural Rubber, Ethylene Propylene Rubber (EPM), Ethylene Propylene Diene Rubber (EPDM), Nitrile Rubber, Neoprene Rubber, Thermoplastic Elastomers (TPE), Silicone Rubber, Polyurethane Rubber, and the like. The polymer is selected for its capacity to reduce or impede acoustic transmission from a flooring surface through a flooring support batten and subsequently through a flooring structural substrate with which it is in contact. Such a polymer may optionally be foamed and may be a closed cell or an open cell foam. Such commercially available foams may be linear or non-linear in nature.

In this embodiment of the invention, the predetermined angle, α is approximately 85 degrees. This enables a resilient fit of a batten (not shown) into the substantially "U" shaped channel 130 formed by first surface 102 of base 101 and side arms 105. One or both side arms of the pair of side arms 105 are elastically deformable to allow fitting of a batten into the "U" shaped channel, either by bending of the side arms 105 or by rotating an elastically deformable hinge or pivot portion 111 between the side arms and the first surface 102 of the base 101 to change angle α. By either method, one or both side arms 105 may be elastically deformed away from their original manufactured position sufficiently to allow insertion of a batten. Side arms 105, once released, will attempt to return to their original position. The position of the side edges of the batten within the "U" shaped channel may result in side arms 105 being resiliently biased against the side edges of the batten.

In a further example of the invention the apertures 107 may be integrally formed into base 101 during manufacture to reduce the amount of material necessary to form the acoustic dampener 101. The size, shape and location of apertures 107 are selectable and may be varied to provide different options selectively tailored for different applications. Apertures 107 may also serve to reduce the contact area between the acoustic dampener 100 and a flooring substructure. In some embodiments, at least one of the apertures 107 may be a continuous channel that also opens through second face 103 of base 101.

The second face 103 of base provides a contact face for the acoustic dampener 100 on a flooring structural substrate (not shown) such as concrete slab and the like.

As shown in FIG. 1(*b*), first face 102 also includes optional visual indicia 118 marked onto, or formed into, the surface, for providing fixing location indicators and the like.

Each of the flanges 106 of the acoustic dampener 101 are orthogonal to side arms 105 and extend in a plane substantially parallel to the first surface 102 of base 101. In the embodiment flanges 106 extend towards each other for a predetermined distance thereby creating a formation adapted to restrain an installed batten in place. Flanges 106 also serve to provide an additional barrier for direct sound transmission between a walking surface sheet and a batten through to the underlying structural substrate.

Dimensions of acoustic dampener 100 may be varied by the manufacturer to suit individual applications. In the embodiment shown, acoustic dampener 100 comprises base 101 having dimensions of between 50 to 100 mm wide. In an alternate embodiment, base 101 may be between 60 to 80 mm wide. In a further embodiment, base 101 is between approximately 75 to 80 mm wide.

In one embodiment, the total height of acoustic dampener 100 may be approximately 20 to 80 mm. In another embodiment, the total height is approximately 25 to 50 mm. In a preferred embodiment, the total height is approximately 30 to 35 mm.

In one embodiment, base 101 are approximately 10 to 15 mm thick, more. In another embodiment, base 101 is approximately 12 mm thick.

In one embodiment, side arms 105 are approximately 10 to 70 mm in height. In another embodiment, side arms 105 are approximately 15 to 40 mm in height. In a preferred embodiment, side arms 105 are approximately 20 to 25 mm. In one embodiment, each of the pair of side arms 105 is angled at approximately 85 degrees to first face 102, and each is approximately 5 mm thick at its first or proximal end and approximately 3 mm thick at its second or distal end.

In one embodiment, each of the pair of flanges 106 may be 10 to 15 mm wide, and each may be approximately 1.5 mm thick.

Each aperture may be approximately 5 mm in diameter where enclosed channels are used, or 5 mm in maximum width in embodiments where a complex shape aperture is used Apertures 107 are arranged in a preselected pattern within the thickness of the base.

Figure 2:
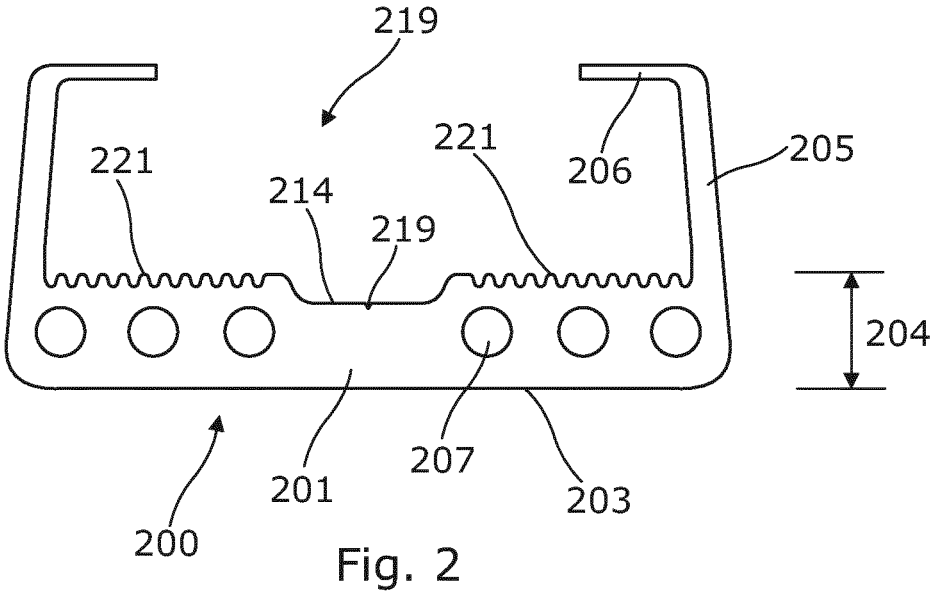
FIG. 2 is a cross sectional view of an acoustic dampener according to a second embodiment of the invention.

Referring now to FIG. 2, there is shown an acoustic dampener 200 comprising a base 201 including first surface 202 and second surface 203 defining thickness 204 therebetween. First surface 202 includes at least one profiled portion 221 for minimising the contact area of first face 202 and a batten installed into the substantially "U" shaped channel 230. In this embodiment, profiled portion 221 is in the form of a series of parallel elongate protrusions approximately 1 mm in height and each approximately 1 mm in width. The surface of each protrusion is profiled, either pointed or rounded or the like, to reduce contact area with a batten surface. First surface 202 also includes and at least one recess 214 for receiving a mechanical fastener such that, once installed, the head of the mechanical fastener sits within the recess and sits below the level of profiled portions 221, thereby preventing contact of the fastener head with an installed batten, creating non-contact zone 228 and preventing a direct path for transmission of acoustic energy from the batten to the building substrate.

Recess 214 may also comprise one or more visual indicia 218 for indicating fixing location points, or may provide an additional location at which the acoustic dampener is elastically deformable.

Apertures 207 formed within thickness 204 allow for an interruption in the possible paths for direct transmission of acoustic energy from a batten through the acoustic dampener to a structural building substrate.

Side arms 205 and flanges 206 function as described for the embodiment of the invention described above in FIG. 1.

Figure 3:
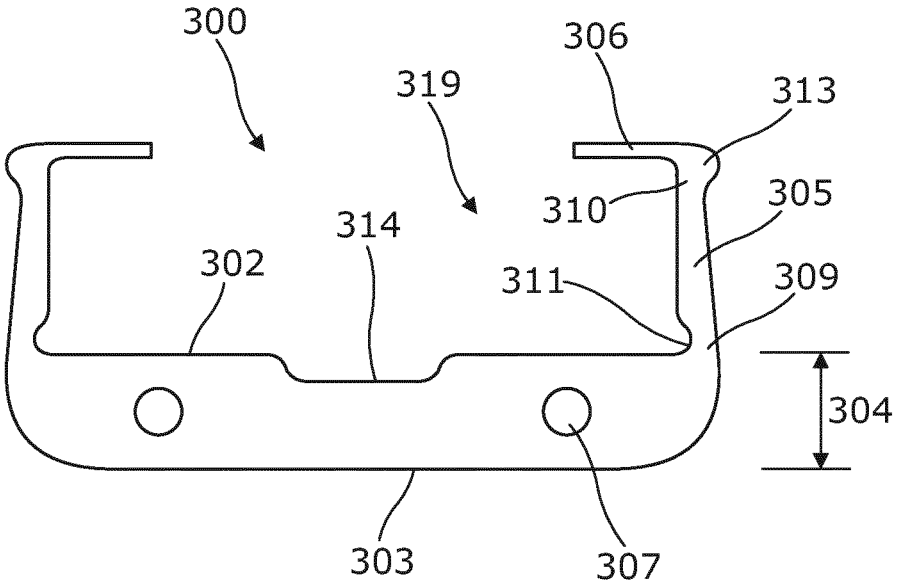
FIG. 3 is a cross-sectional view of an acoustic dampener according to a third embodiment of the invention.

Referring now to FIG. 3, there is shown a further embodiment of the acoustic dampener 300 of the invention including base 301 comprising first face 302 and second face 303 spaced apart to define thickness 304 therebetween. As described above, side arms 305 extend at a predetermined angle α from base 301. Flanges 306 each extend orthogonally from respective distal edges 310 of side arms 305. In this embodiment of the invention, at least one of the pair of side arms 305 is connected to base 301 at its proximal end 310 by elastically deformable hinge or pivot portion 311.

The mechanical strength of the connection of at least one of the pair of flanges 306 to a respective distal edge 310 of respective side arm 305 may be strengthened by including reinforcing portion 313. In this embodiment of the invention, arm 305 is elastically deformable by relative rotation of elastically deformable hinge portion 311.

Elastically deformable hinge portion 311 in this embodiment is integrally formed with base 301 and side arms 305 and is radiused to provide a portion having a reduced wall thickness relative to side arm 305.

Figure 4:
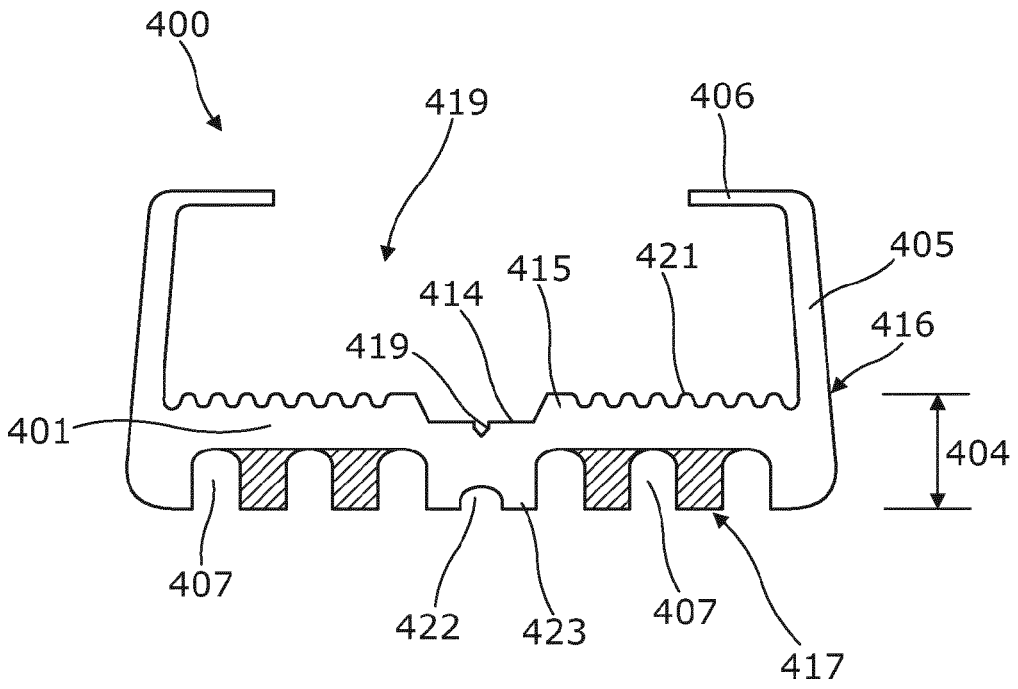
FIG. 4 is a cross sectional view of an acoustic dampener according to a fourth embodiment of the invention.

A fourth embodiment of the invention is shown in FIG. 4, which provides an acoustic dampener 400 including base 401 comprising first face 402 and second face 403 spaced apart to define thickness 404 therebetween. First face 402 includes at least one profiled portion 421 for minimising contact, when in use, between first face 402 and an installed batten (not shown).

First face 402 also includes at least one recess 414 with side portions 415 for providing tapering transition zone and a support zone. First recess 414 in first face 402 optionally includes visual indicia 418 such as for indicating fixing locations. In this embodiment, visual indicia 418 is in the form of a small recessed channel in the centre of first recess 414. Recess 414 also reduces the amount of material a mechanical fixing has to penetrate during installation and increases the ease of installation.

FIG. 4 also shows one embodiment of acoustic dampener 400, where a co-extrusion process is used to integrally form base 401 from two resilient polymeric materials, each having different acoustic dampening properties. The materials may also have differing mechanical properties such as hardness or strength. In this figure, base 401 includes at least one portion 416 of a first material and at least one portion 417 of at least a second material. In alternate embodiments, portion 416 and portion 417 may be formed from the same material, but in different physical form, thereby providing portions each having different physical properties, such as a non-foamed and a foamed polyolefin. For example, portion 417 may be formed from a nonlinear polyolefin foam and portions 416, 405 and 406 formed from a linear polyolefin foam showing different acoustic response characteristics.

Base 401 also includes $3^{rd}$ recess 422 formed in second face 403. Adjacent at least one edge of $3^{rd}$ recess 422 is support portion 423 for providing mechanical support around fixing points. Fixing points may be indicated by visual indicia 418 created by $2^{nd}$ recess 419 in first surface 402. In this embodiment of the invention, apertures 407 are in the form of channels extending from the interior of thickness 404 to second face 403 of base 401.

Figure 5:
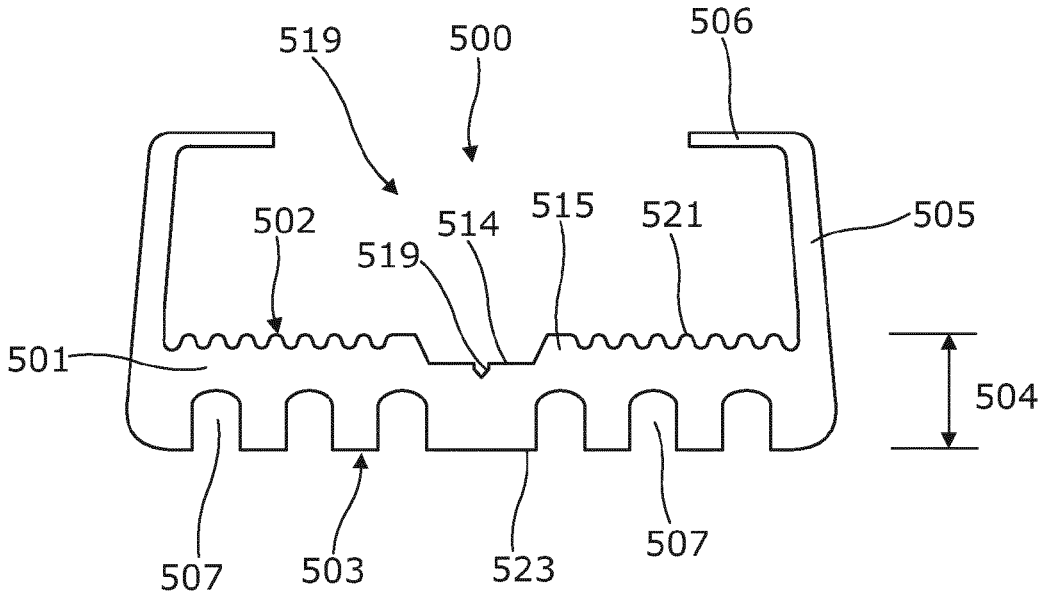
FIG. 5 is a cross-sectional view of an acoustic dampener according to a fifth embodiment of the invention.

FIG. 5 shows one embodiment of the invention where acoustic dampener 500 is integrally formed of a single synthetic rubber material. The acoustic dampener is extruded as one or more convenient to handle lengths. Examples of convenient to handle lengths may be 3 meters, 5 meters, 10 meters or more. Acoustic dampener 500 may be supplied flat or rolled. Of course other convenient lengths may be similarly manufactured.

Base 501 comprises first surface 502 and second surface 503 defining a thickness 504 therebetween. First surface 502 comprises two profiled portions 521 disposed either side of first recess 514. Profiled portions 521 are in the form of a series of parallel ridges formed into the surface of first surface 502. The ridges are approximately 1 mm in height and approximately 1 mm diameter and spaced approximately 1 mm apart.

Side arms 505 are 5 mm thick at their proximal ends and 3 mm thick at their distal ends. Side arms 505 are 20 mm long. Flanges 506 are 3 mm thick and 16 mm wide. Angle α between side arms 505 and base 501 is 85 degrees.

Base 501 has apertures 507 in the form of channels formed in thickness 504 and extending through second surface 503. The apertures are approximately 5 mm in width and approximately 7.5 mm deep, terminating as radiused arch formations within thickness 504. A number of apertures 507 are disposed evenly distributed across the width of base 501.

First surface 502 further comprises first recess 514 in the form of a recessed channel with tapered side edges transitioning from first surface 502 to the and of the recess for providing fixing locations for fixing the acoustic dampener to a building structural substrate such as a timber flooring frame. Visual indicia 518 in the form of a 1 mm deep and 1 mm diameter central channel located in the land of first recess 414 provides a visual guide to fixing locations, while simultaneously slightly reducing the thickness of material that a mechanical fixing such as a screw has to penetrate before contacting the substrate.

Figure 6C:
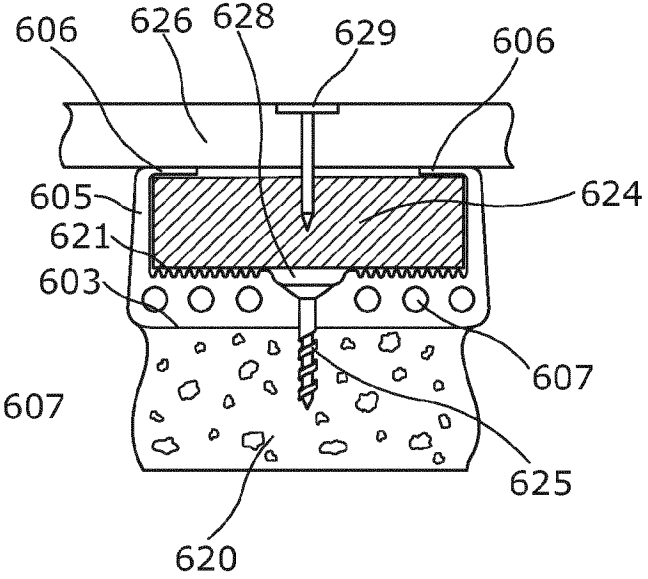
FIGS. 6 (*a*), 6 (*b*) and 6 (*c*) are cross-sectional views of the acoustic dampener of FIG. 2 in an installed position; of the acoustic dampener in an installed position with a batten being installed; and a floor section comprising the batten and the acoustic dampener according to the invention.
Figure 6B:
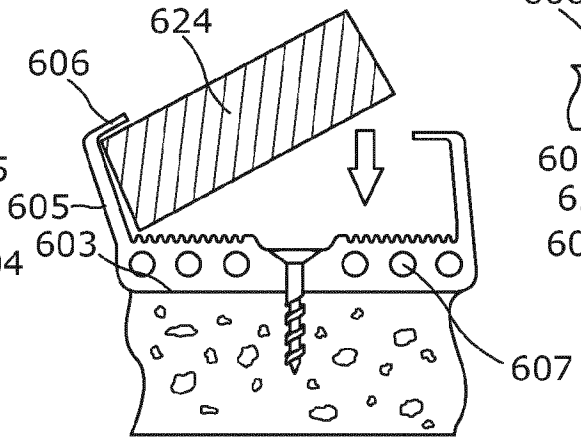
Figure 6A:
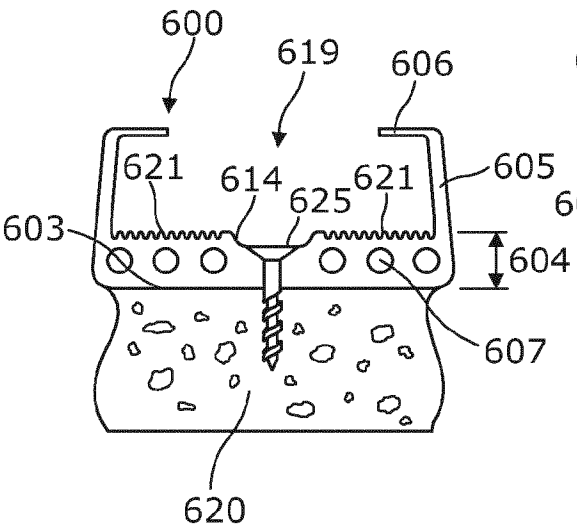
Figure 7C:
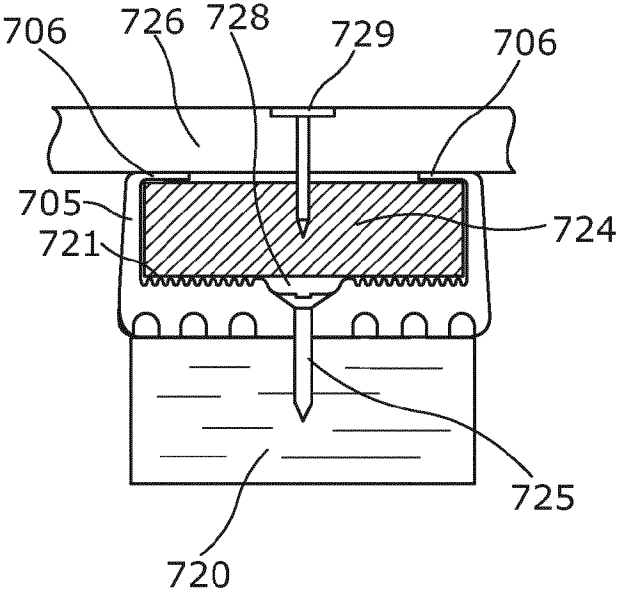
FIGS. 7 (*a*), 7 (*b*) and 7 (*c*) are cross-sectional views of the acoustic dampener of FIG. 5 in an installed position; of the acoustic dampener in an installed position with a batten being installed; and a floor section comprising the batten and the acoustic dampener according to the invention.
Figure 7B:
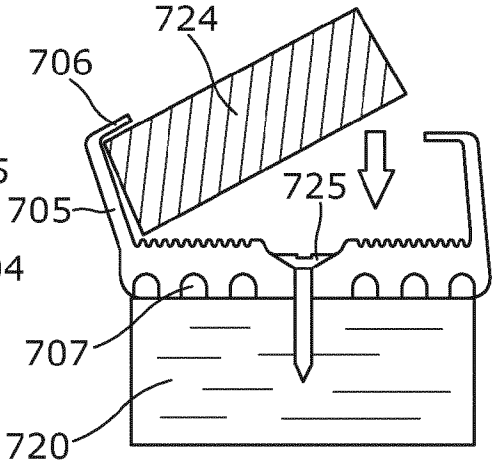
Figure 7A:
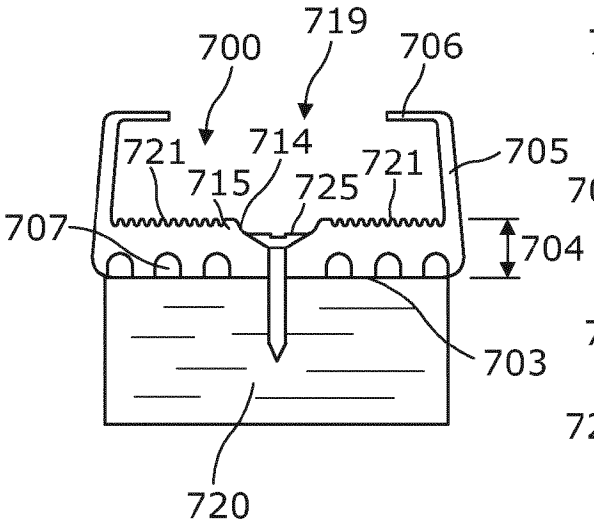

Installation of an acoustic dampener according to one embodiment of the invention is shown in FIG. 6 in which FIG. 6(*a*) shows acoustic dampener 600 positioned in a user selectable position on the surface of a building structural substrate 620 in the form of a concrete slab. Other building structural substrate materials such as a plywood, MDF, OSB or other flooring substrate materials may also be appropriate. Acoustic dampener 600 is fixed in position by mechanical fastener 625, in this embodiment; mechanical fastener 625 is a screw suitable for use on masonry. Fastener 625 is driven into first recess 614 in first surface 602, through thickness 604, exiting through second surface 603 and fastening to structural building substrate 620. Apertures 607 are not deformed during the installation process and provide maximum disruption to sound transmission. Acoustic dampener 600 may be in the form of an extruded section of predetermined length or may be in the form of a roll of sufficient length to cover the length or width of a building or room floor surface, in which case, it may be cut to the required length by the installer.

FIG. 6(*b*) shows installation of batten 624 by elastically deforming at least one of the pair of side arms 605 by bending outwards, increasing the angle between side arm 605 and first face 602 and inserting batten 624 into channel 619. Once batten 624 is in position, each of the elastically deformed side arms 605 is allowed to return substantially to its original position, leaving a small degree of elastic deformation which provides a resilient bias of side arms 605 against batten 624 to assist in securing batten 624 in position. Ranges 606 retain the batten in position within channel 619.

Once batten 624 is in position, flooring material 626, in the form of a fibre cement flooring sheet in this embodiment, can be fixed to batten 624 by mechanical fastener 629, as shown in FIG. 6(*c*). Flooring material 626 remains substantially isolated from direct contact with batten 624 by pair of flanges 606. Flooring material 626 also remains isolated from direct contact with structural building substrate 620.

Direct transmission of acoustic energy from flooring materials 626 to structural building substrate 620 is reduced or substantially eliminated by combined action of acoustic dampening properties of the resilient polymer selected; by selected profiling of the acoustic dampener to minimise contact area between the first face and the batten; by incorporation of acoustic transmission disrupting apertures in the thickness of the acoustic dampener; by optional reduction in the contact area between batten 624 and building structural substrate 620; by providing a spacer between the flooring material 626 and batten 624 via flanges 605; by eliminating any direct hard surface contact of flooring material 513 with building structural substrate 620; and by eliminating direct contact between mechanical fastener 625 and batten 624. Airborne transmission is also reduced by dampening transmission into airspace within the floor structure, from battens 624, by side arms 605.

Examples of acoustic dampeners according to embodiments of the invention are provided below.

EXAMPLE ONE

This example demonstrates the improvement in acoustic performance achievable using acoustic dampeners according to one embodiment of the invention. In this example, a timber structural substrate, in the form of a flooring subframe, is constructed in the normal way with 100×75 mm bearers supporting 100×50 mm joists spaced at 600 mm centres. This timber structural substrate forms the base of the flooring system in a building construction.

In this example, acoustic dampeners of the invention are in the form of extruded sections 3 meters in length. Each acoustic dampener is made from an EPDM rubber having a Shore hardness of 45-50. The acoustic dampener has a base 76 mm wide at its widest point, with the lower corners radiused at a 2 mm radius. The second surface of the base has a series of recessed channels 5 mm wide, 6 mm deep and evenly spaced 5 mm apart across the second surface. Each channel termination within the thickness is radiused at about a 2.5 mm radius. A centre support portion of the lower face of the base does not include any recessed channels, in order to provide additional support around the screw fixing locations. This centre portion is 12 mm wide.

The acoustic dampener base is 12 mm thick at its thickest point. On the first surface of the base, a series of parallel channels 1 mm deep are formed to reduce the direct contact area between the lower surface of a batten and the first surface of the acoustic dampener. A first recess 12 mm wide, located centrally in the first face of the base and recessed by 3 mm into the base, provides a convenient location for screw fixing the acoustic dampener to the subfloor, in this case to a joist. The screw head, when tightened down, sits within the first recess and sits below the plane of contact between the first surface of the acoustic dampener base and the lower surface of an installed batten, leaving a non-contact zone between the fastener head and the batten, thereby preventing direct contact and any direct pathway for sound transmission.

At each side edge of the base, a side arm 3 mm thick protrudes almost orthogonally at an angle of 85 degrees to the upper face of the base, angled towards the centre of the base. Each side arm is 22 mm in length from the top surface of the base. At the end of each side arm, a flange 1.5 mm thick extends parallel to the upper surface of the base, towards the centre.

Acoustic dampeners are fixed to the joists, in this example, at a spacing of 600 mm Each acoustic dampener is fixed to the joist using screws. Fixing points may optionally be indicated on the surface of the acoustic dampener by printed marks, embossed marks, and the like. Once the acoustic dampeners are fixed in place, timber battens 70 mm wide and 19 mm thick are inserted into each acoustic dampener by elastically deforming one or both side arms of the acoustic dampener to allow full insertion of a batten into an acoustic dampener.

Once the timber batten is in place, a walking surface is positioned over the battens and is fixed to the battens at manufacturer recommended spacings. The underside of the walking surface contacts the flanges of the acoustic dampener and direct contact between the walking surface and the batten is prevented.

In this embodiment, the walking surface comprises 22 mm thick fibre cement flooring sheets installed according to the manufacturers recommendations. In this example, a lightweight nailable structural flooring product Secura™ Interior Flooring manufactured by James Hardie Australia Pty Ltd was used. Secura™ Interior Flooring may be nail fixed to a substrate, other flooring materials such as compressed fibre cement sheet may need to have holes pre-drilled at recommended fixing spacings before the flooring sheets are screw fixed to the battens.

Results

Results of acoustic testing are provided below in Table 1.

TABLE 1

| Walking Surface thickness (mm) | Joist Spacing (mm) | Acoustic dampener used? | Airborne Rw + Ctr | Impact Lnw |
|---|---|---|---|---|
| 22 | 600 | No | 52 | 67 |
| 22 | 600 | Yes | 57 | 55 |

EXAMPLE 2

In this embodiment of the invention, a timber subframe is constructed in the normal way using 100×75 mm timber bearers and 100×50 mm joists at 600 mm centres.

Acoustic dampeners are screw fixed to the joists. In this example, each acoustic dampener is formed from an EPDM rubber having a Shore hardness of 50-55.

In this example, each acoustic dampener is in the form of an extruded section 10 meters in length and supplied in roll form that can be cut to the required lengths. Where there is a section too short to fit the desired location, another length can be cut from another roll to make up the difference. The leading end of the new length can be butted up against the trailing end of the preceding length to ensure continuity of performance along the length of the joist.

The acoustic dampener has a base 77 mm wide at its widest point, with the lower corners radiused at a 2 mm radius. The thickness of the base has a series of 6 circular cross-section apertures each 5 mm diameter spaced 10 mm apart, in two groups of three distributed symmetrically either side of the first recess in the first face. The centre of each aperture is approximately 6 mm from the second surface of the base and each aperture extends substantially parallel to the second face, through the length of each acoustic dampener.

The acoustic dampener base is 12 mm thick at its thickest point. On the first surface of the base, a series of parallel channels 1 mm deep are formed to reduce the contact area between the lower surface of a batten and the first surface of the acoustic dampener. A first recess 16 mm wide, located centrally in the first face of the base and recessed by 3 mm into the base, provides a convenient location for screw fixing the acoustic dampener to the subfloor, in this case to a joist. The screw head, when tightened down, sits within the first recess and sits below the plane of contact between the first surface of the acoustic dampener base and the lower surface of an installed batten, leaving a non-contact zone between the fastener head and the batten, thereby preventing direct contact and any direct pathway for sound transmission.

At each side edge of the base, a side arm 3 mm thick protrudes almost orthogonally at an acute angle of 85 degrees to the first face of the base, angled towards the centre longitudinal axis of the base. Each side arm is approximately 21 mm in length from the first surface of the base. At the end of each side arm, a flange 1.2 mm thick and 12 mm long extends parallel to the first surface of the base, towards the central longitudinal axis. At the distal ends of the side arms, the acoustic dampener is 71 mm in width. A side arm thickness of 3 mm each makes the width of the channel into which the batten is fitted, about 65 mm.

Acoustic dampeners are fixed to the joists, in this example, at a spacing of 600 mm. Each acoustic dampener is fixed to the joist using timber screws. Fixing points may optionally be indicated on the surface of the acoustic dampener by printed marks, embossed marks, and the like. In this example, visual inidica indicating fixing locations is in the form of a $2^{nd}$ recess in first surface of the base. The $2^{nd}$ recess is 0.5 mm wide and 0.5 mm deep and is located in the centre of the first recess and extends along the length of the acoustic dampener.

Once the acoustic dampeners are fixed in place, timber battens 70 mm wide and 19 mm thick are inserted into each acoustic dampener by elastically deforming the acute angle of one or both side arms of the acoustic dampener to allow full insertion of a batten into an acoustic dampener. Once in position, the side arms are allowed to relax and return as much as possible to their original position. The width of the batten at 70 mm means that the distal ends of each side arm is slightly elastically deformed from its original position, and is resiliently biased against the side of the batten, thereby assisting in retaining the batten securely in place and with little or no ability to move out of position.

Once the timber batten is in place, a walking surface is positioned over the battens and is fixed to the battens at manufacturer recommended spacings. The underside of the walking surface contacts the flanges of the acoustic dampener and direct contact between the walking surface and the batten is prevented.

In this embodiment, the walking surface comprises 22 mm thick fibre cement flooring sheets installed according to the manufacturers recommendations. In this example, a lightweight nailable structural flooring product, Secura™ Interior Flooring manufactured by James Hardie Australia Pty Ltd was used. Secura™ Interior Flooring may be nail fixed to a substrate, other flooring materials such as compressed fibre cement sheet may need to have holes pre-drilled at recommended fixing spacings before the flooring sheets are screw fixed to the battens.

Results

Results are given in Table 2 below.

TABLE 2

| Walking Surface thickness (mm) | Joist Spacing (mm) | Acoustic dampener used? | Airborne Rw + Ctr | Impact Lnw |
|---|---|---|---|---|
| 22 | 600 | No | 52 | 67 |
| 22 | 600 | Yes | 58 | 54 |

It will be appreciated that the illustrated acoustic dampener provides an acoustic dampener for use in building construction, for decoupling contact between all hard surface components and thereby reducing acoustic energy transmission, while maintaining low component cost and low installation skill level.

The acoustic performance of all examples provided above meets or exceeds the UK Building Code ADE AAA3 (Resistance to the Passage of Sound) provisions for an $L'_{nT,w}$ maximum value of 64 dB for floors, and stairs in buildings. (The lower the value the better). The $L'_{nT,w}$ value is the impact sound pressure level in a stated frequency band, corrected for reverberation time, according to BS EN ISO 140-7:1998.

The $D_{nT,w}+C_{tr}$ standards for airborne noise transmission between rooms are also met or exceeded by all examples provided above. The $D_{nT,w}+C_{tr}$ minimum value under the code is 43 dB. $D_{nT,w}$ is a measure of the difference in sound pressure level in dB between a room in which the sound/noise is generated and an adjacent "receiving room", at a prescribed reverberation time. In simple comparison terms, the higher the value of $D_{nT,w}$, the better the acoustic performance of the material/construction is. The larger the number, the larger is the difference in sound pressure level discernible in the two spaces, and therefore, the more effective is any acoustic dampener used in the test structure, $C_{tr}$ is a correction factor used in conjunction with $D_{nT,w}$ to allow for low frequency bass sounds in airborne transmission.

Sound pressure levels are typically reported in decibel (dB) units. With 0 dB representing the threshold of audibility for a person of normal hearing capacity and 100 dB representing, say, the noise level in a subway railway station or heavy industrial machinery in operation. In a normal daily urban environment, a person may be exposed to sound levels such as average street noise at around 70 dB, an average office environment at around 60 dB, an average conversation at around 50 dB, and a quiet or private office at around 40 dB. The correlation between sound intensity and sound pressure is logarithmic and an increase of 10 dB in sound pressure level represents a 10-fold increase in sound intensity level, so the sound intensity at 100 dB is 10,000,000,000 times greater than that at 0 dB. For a person of normal hearing, a change of 1-2 dB is not detectable. A change of 5 dB, however, is clearly detectable and a change of 10 dB is regarded as either a halving (if reduced by 10 dB) or doubling (if increased by 10 dB) of the noise level. A relatively small change in dB sound levels may, in fact, represent a significant change in the sound intensity in a environment.

Many sounds that people are exposed to in a modern environment span across a range of frequencies from about 50 Hz up to about 10 kHz. Voices are predominantly in the 100-300 Hz range. Heavy vehicles may be in the 50-1000 Hz range and car horns are in the AAA-5000 Hz range. All of the sounds in an environment may reach a person at different sound intensity depending on how far away they are from the source, any material between the person and the source of the sound that may act to absorb or transmit those sounds, and the sound travel pathways available.

Each material will have a characteristic sound absorption/transmission effectiveness depending not only its inherent material properties, but also its physical configuration such as shape, thickness and the like. Sound may also be transferred either directly through the material of a building section such as a wall or floor section &/or indirectly through airborne transmission.

Creating an environment for people, such as in residential dwellings or office/commercial spaces, requires that noise or sound intensity levels are managed. The ideal is to create an environment where sound intensity, through both direct and indirect transmission pathways, is below nuisance levels both for the person themselves and for any immediately adjacent neighbours.

It will of course be understood that the invention is not limited to the specific details described herein, which are given by way of example only, and that various modifications and alterations are possible within the scope of the invention as defined in the appended claims.

The invention claimed is:

1. An acoustic dampener comprising:

a base member, wherein the base member comprises a first surface and a second surface, the first and second surface being spaced apart from each other defining a thickness therebetween, said base member comprising at least one internal aperture contained within the thickness of the base member between the first and second surface;

at least two side arms, wherein each side arm comprises a first end and a second end, each side arm extending from the first surface of the base member at a pre-determined angle, such that there is a channel formed therein whereby each side arm and the base member form the sides and the base of the channel formation respectively; and a pair of flanges, each flange extending substantially orthogonally from the second end of each side arm and wherein the predetermined angle is elastically deformable, wherein the pair of flanges extend towards each other for a distance thereby creating a formation adapted to restrain an installed batten in place, wherein the first surface of the base member comprises at least one profiled portion, said profiled portion configured to reduce contact area between the base member and the installed batten.

2. An acoustic dampener as claimed in claim 1, wherein at least one of the pair of side arms is pivotably connected to the base member.

3. An acoustic dampener as claimed in claim 1, wherein at least one of the pair of flanges is pivotably connected to a respective second end of one of the pair of side arms.

4. An acoustic dampener as claimed in claim 1, wherein the at least one aperture extends through the second face of the base member to form at least one recessed channel.

5. An acoustic dampener as claimed in claim 1, wherein the base member comprises at least one resilient polymer material.

6. An acoustic dampener as claimed in claim 5, wherein the at least one resilient polymer is a closed cell foam.

7. An acoustic dampener as claimed in claim 6, wherein the closed cell foam is a closed cell linear foam.

8. An acoustic dampener as claimed in claim 6, wherein the closed cell foam is a closed cell non-linear foam.

9. An acoustic dampener as claimed in claim 6, wherein the resilient foam is a polyolefin foam.

10. An acoustic dampener as claimed in claim 1, wherein the base member, at least two side arms and the pair of flanges are integrally formed together.

11. An acoustic dampener as claimed in claim 1, wherein the acoustic dampener is formed by an extrusion process.

12. An acoustic dampener as claimed in claim 11, wherein the extrusion process is a co- extrusion process.

13. An acoustic dampener as claimed in claim 12, wherein the base member comprises at least two portions formed of materials having different acoustic dampening properties.

14. A floor structure comprising an acoustic dampener as claimed in claim 1 securable to a structural substrate, a batten disposed within the channel formation and flooring material secured to the batten.

15. A floor structure as claimed in claim 14, wherein the batten is a fibre cement batten.

16. A floor structure as claimed in claim 14, wherein the flooring material is a fibre cement flooring material.

17. A method of installing a floor structure, including the steps of:

(a) selecting and/or preparing one or more lengths of acoustic dampener as claimed in claim 1;

(b) fixing each length of acoustic dampener in a predetermined position on a structural flooring substrate to form an acoustic dampener array, (c) elastically deforming at least one side arm on each length of acoustic dampener array and inserting batten sections into each length of acoustic dampener to substantially fill the "U" shaped channel to form a batten array, (d) allowing the side arm on each length of acoustic dampener to return to its substantially original position, and (e) fixing at least one flooring sheet to each batten section, wherein only the acoustic dampener array is directly fixed to the flooring structural substrate and each flooring section is directly fixed only to at least one batten section in the batten array.

* * * * *